US005090224A

United States Patent [19]

Svagr et al.

[11] Patent Number: 5,090,224

[45] Date of Patent: Feb. 25, 1992

[54] METHOD OF DETERMINING THE SPRING CHARACTERISTIC OF A ROLL STAND

[75] Inventors: Alexander Svagr, Hilden; Georg Engel, Kaarst; Hugo Feldmann, Alsdorf, all of Fed. Rep. of Germany

[73] Assignee: SMS Schloemann-Siemag Aktiengesellschaft, Düsseldorf, Fed. Rep. of Germany

[21] Appl. No.: 632,169

[22] Filed: Dec. 21, 1990

[30] Foreign Application Priority Data

Dec. 22, 1989 [DE] Fed. Rep. of Germany ..... 3942452

[51] Int. Cl.[5] ..... B21B 31/20; G01L 5/00

[52] U.S. Cl. ..... 72/20; 72/21; 72/35; 72/246; 72/248; 73/862.55

[58] Field of Search ..... 72/19, 20, 21, 31, 32, 72/35, 225, 237, 238, 246, 248; 73/862.55, 1 B; 364/472

[56] References Cited

U.S. PATENT DOCUMENTS

| | | | |
|---|---|---|---|
| 3,533,255 | 10/1970 | Sims | 72/21 |
| 4,127,997 | 12/1978 | Quehen | 72/19 |
| 4,918,964 | 4/1990 | Engel et al. | 72/225 |
| 4,944,175 | 7/1990 | Svagr et al. | 72/225 |

FOREIGN PATENT DOCUMENTS

| | | |
|---|---|---|
| 1291715 | 4/1969 | Fed. Rep. of Germany . |
| 2057960 | 6/1972 | Fed. Rep. of Germany . |
| 2606842 | 8/1977 | Fed. Rep. of Germany . |
| 3039203 | 5/1982 | Fed. Rep. of Germany . |

*Primary Examiner*—Lowell A. Larson
*Assistant Examiner*—Thomas C. Schoeffler
*Attorney, Agent, or Firm*—Toren, McGeady & Associates

[57] ABSTRACT

A method of determining the spring characteristic of a roughing and finishing stand and a method of adjusting the roll gap of the roll stand prior to rolling, particularly for rolling lightweight sections with narrow tolerances, wherein at least one horizontal roll of the stand is adjustable. The stand has a swingable stand top which connects the housing posts of the stand housings, wherein the stand top is connected to the housing posts by tie rods which are pretensioned by a hydraulic tensioning device. At least the upper of the horizontal rolls is moved by an electromechanical adjustment unit of the rolls towards the other roll and the rolling forces to be measured between the roll bodies is applied by the hydraulic tensioning device, wherein the electromechanical adjustment unit is adjustable by predeterminable adjustment distances in the unloaded state while maintaining roll contact.

6 Claims, 2 Drawing Sheets

METHOD OF DETERMINING THE SPRING CHARACTERISTIC OF A ROLL STAND

BACKGROUND OF THE INVENTION

1. Field of the Invention

The present invention relates to a method of determining the spring characteristic of a roughing and finishing roll stand and to a method of adjusting the roll gap of the roll stand prior to rolling, particularly for rolling lightweight sections with narrow tolerances, wherein at least one horizontal roll of the stand is adjustable, preferably electromechanically.

2. Description of the Related Art

Roll housings of split construction are known from German Offenlegungsschrift 20 57 960. The roll housings have removable tops and tie rod connections between the housing and the housing tops, wherein the tie rods are mounted so as to be swingable laterally out of the roll stand about axes arranged in the lower housing portion. In addition, the tie rods can be tensioned or pretensioned for the operation of the roll stand by means of hydraulic tensioning units arranged at the heads of the tie rods. The pretensioning pressure continues to act on the tie rod heads during the rolling operation. In this tie rod connection, the hydraulic tensioning unit consists of a cylindrical member which causes the length of extension of the tie rod and of a threaded nut which is subsequently turned further by the length of extension. The pressure medium does not act on the cylindrical member during the operation of the roll stand.

In accordance with a further development disclosed in German Offenlegungsschrift 26 06 842, the pressure medium producing the pretensioning forces can be switched centrally and jointly on and off to the tensioning units of one or more roll stands. Depending on the extent by which the pretensioning pressure is released, the tie rods of one or more roll stands can be swung centrally and jointly by means of the hydraulically acting piston-cylinder units. When the tie rods are swung out of the roll stands, the upper housing tops can be lifted off upwardly. For carrying out the roll exchange, the unit receiving the two horizontal rolls is lifted upwardly and out of the stand by means of a crane arrangement. These measures have the purpose to reduce the time required for the roll exchange and to substantially mechanize the roll exchange.

German Auslegeschrift 12 91 715 discloses a roll stand with open-top housings in which after removal of the housing tops, the chocks of the rolls can be lifted out upwardly. The tops have projections arranged on components which project between the housing columns. The projections engage the upper limiting surfaces of recesses of the aperture sides and can be fixed to the columns by means of tensioning means which act between the projections and the housing columns in direction of the adjusting spindles. The tops can be moved laterally. For this purpose, the housings include a rail arrangement and the tops have drive rollers. When the tops are moved laterally, the stand is open toward the top, so that the roll exchange can be carried out through the open top of the stand. The purpose of these measures is to simplify the roll exchange and to accelerate the roll exchange.

A universal stand with horizontal and vertical rolls in a common vertical axial plane is known from German Offenlegungsschrift 30 39 203. The universal stand includes a frame for the vertical rolls which is closed with respect to the forces being applied. Adjusting spindles for the vertical rolls are mounted in the yokes of the frame. The chocks of the horizontal rolls are supported in pairs in an upper and a lower transverse yoke, wherein the transverse yokes are supported by tension spindles which are axially movably arranged in the frame and the transverse yokes are centrally adjustable relative to the pitch line. The two upper transverse yokes can each be swung out symmetrically laterally relative to the pitch line because the transverse yokes are supported in the swing axis through an extended additional bushing on the tension spindles forming the swing axes. The transverse yokes are swingable so that it is not necessary to provide lifting means, for example, a crane arrangement, for lifting out the transverse yokes. The purpose of this arrangement is to further reduce the roll exchange times.

The above-described roll stands with roll housings of split construction have in common that the different arrangements of the transverse yokes or tops connecting the roll housings make it possible to open the stand quickly at the top so that the roll exchange or the change of the roll sets car be carried out as quickly as possible. None of the references referred to above mention that it is possible with pretensioned open-top stands to roll material within narrow tolerances and with high measuring accuracy only when the expansion behavior of the entire stand including the rolls is known in any selected loading condition and when the rolling mill stand can be exactly adjusted prior to rolling. The speed of the roll exchange is not the only criterion important for the quality of a stand of split construction with housing tops.

SUMMARY OF THE INVENTION

It is, therefore, the primary object of the present invention to provide, in a pretensionable open-top stand, i.e., a universal stand which is refitted to a pretensionable two-high stand, a method which makes it possible to determine the spring characteristic of the stand in a reproducible manner, so that, when rolling under various load conditions in accordance with the desired dimensions, the springiness of rolls and stand can be taken into consideration without problems and the roll stand can be adjusted prior to rolling with the appropriate accuracy.

In accordance with the present invention, in a rolling mill stand with removable or swingable housing top which connects the housing posts of the stand housings, wherein the stand top is connected to the housing posts by means of tie rods which are pretensioned by means of hydraulic tensioning units, at least the upper of the horizontal rolls is moved by their electromechanical adjustment unit of the rolls toward the other roll and the rolling force F to be measured between the roll bodies is applied by the hydraulic tensioning unit, wherein the electromechanic adjustment is possible in the unloaded state, while maintaining roll contact by predeterminable adjustment distances L.

Moreover, in accordance with the present invention, the above-described method for determining the spring characteristic in an open-top stand is also proposed in a rolling mill stand which is reassembled from an universal stand to a two-high stand of tie rod construction.

The determination of the spring characteristic of an open-top stand, or of a universal stand reassembled to a two-high stand, in accordance with the method described above, makes it possible in an advantageous manner to take into consideration the rolling forces which are always different from section to section and the respective springiness of the stand in such a way that sections can be rolled with a high accuracy to size. If new rolls with different passes are to be mounted in the stand, the possibly new spring characteristic of the new rolls and of the rolling mill stands can also be determined quickly and simply. It is of particular significance that the electromechanical adjustment unit is only adjusted in the state in which no forces are applied; this leads to a considerable technical simplification of the machinery. In addition, the spring characteristic determined in accordance with the method of the present invention makes it possible to roll sections of highest quality and narrow tolerances with pretensioned rolls because the stand can be adjusted prior to rolling extremely accurately to the required pretensioning force.

In accordance with a further development of the invention, the upper horizontal roll is moved by the electromechanical adjustment unit with decreasing speed against the lower horizontal roll, wherein the adjustment speed becomes zero at the moment the rolls come into contact. Accordingly, the rolls are moved toward each other in a programmed manner until the rolls come into contact with each other, i.e., the moment of so-called "roll kissing", in order to avoid damage of the roll surfaces and the roll passes. The moment of roll kissing can be monitored, for example, by means of pressure pickups which register a pressure increase and which stop the adjusting movement of the roll.

In accordance with a preferred development of the invention, wherein a tensioning nut is the tensioning unit, the following steps are carried out in the sequence mentioned below and in a repeatable cycle n. Each hydraulic tensioning nut for each tie rod, i.e., two tensioning nuts per stand housing, is untensioned; subsequently, the electromechanical adjustment unit is moved together by a predetermined adjustment distance $L_n$ with the requirement that the stand top and the housing posts are loosely spaced apart; all hydraulic tensioning nuts of the stand are then again pretensioned, wherein the force applied as a result is measured as the rolling force $F_n$ between the roll bodies; the adjustment distance $L_n$ of the electromechanical adjustment and the rolling force $F_n$ measured between the rolls are fed to a computer unit for determining the corresponding spring characteristic value $K_n$ and, thus, for determining the spring characteristic of the stand. In this connection $n=1$ to $n=X$ is the number of cycles which can be carried out as selected in order to determine through several spring characteristic values K1, K2, K3 . . . Kx a spring characteristic which is as representative as possible through the individual computed spring characteristic values K1, K2, K3 etc.

Since the tops of the stands rest against the posts, the introduction of the forces into the open-top stands by means of the tensioning units results in a mechanical synchronization of the introduced forces. If such high forces were introduced into the stand in accordance with the prior art by means of a hydraulic roll adjustment, the rolls would be misaligned, so that only an inaccurate adjustment of the stand to new sections could be carried out. There would also be the danger that the rolls and roll adjustment units are mechanically jammed and can only be released again with significant effort. These technical problems do not occur in the method in accordance with the present invention.

In view of the above considerations, a further development of the invention provides that the first spring characteristic value $K_o$ is determined through a pressure increase adjusted above the pretensioning pressure in the hydraulic tensioning nut while simultaneously measuring the corresponding rolling force between the roll bodies and the corresponding adjustment distance and that at least one characteristic value $K_n$ is determined by untensioning the hydraulic tensioning nut and closing the electromechanical adjustment unit by a predetermined distance $L_n$ which has the result that the stand top and the housing both are loosely spaced apart from each other. Subsequently, the hydraulic tensioning nuts are again pretensioned and the force applied as a result is measured as the rolling force $F_n$ between the roll bodies. As described above, the adjusting distances L1, L2 etc. and the measured rolling forces F1, F2, etc., are supplied to a computer unit for determining the corresponding spring characteristic values K1, K2, etc., and, thus, for determining the spring characteristic of the stand. The result of this computing operation may be graphically shown on a display unit connected to the computer.

If the tie rod of the open-top stand is pretensioned by means of a tensioning unit which is unloaded from hydraulic pressure during rolling operation, for example, by means of insertable pressure pieces, the following steps are proposed. To the hydraulic tensioning unit of all tie rods a pressure is supplied which is adjusted above the pretensioning pressure, with the result that the electromechanical adjustment unit is unloaded with respect to the forces applied to it. Subsequently, the electromechanical adjustment unit is adjusted by an adjustment distance $L_n$ while maintaining contact of the rolls; the hydraulic tensioning units are then again untensioned and the rolling forces $F_n$ applied as a result to the roll bodies are measured. Finally, the adjustment distance $L_n$ and the measured rolling force $F_n$ are supplied to a computer unit for determining the corresponding spring characteristic value $K_n$ and thus, for determining the spring characteristic of the stand. In order to determine several spring characteristic values K1, K2, etc., the above steps can be repeated several times in the aforementioned cycle, so that a representative spring characteristic is obtained.

In accordance with another proposal, the spring characteristic of the open-top stand determined by the above-described steps can be used when rolling sections with rolls which are moved toward each other and are pretensioned, wherein the pretensioning force is always greater than the rolling force. Accordingly, the rolling forces required for rolling sections are applied by means of the already existing tensioning units, so that additional hydraulic cylinders are not required.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
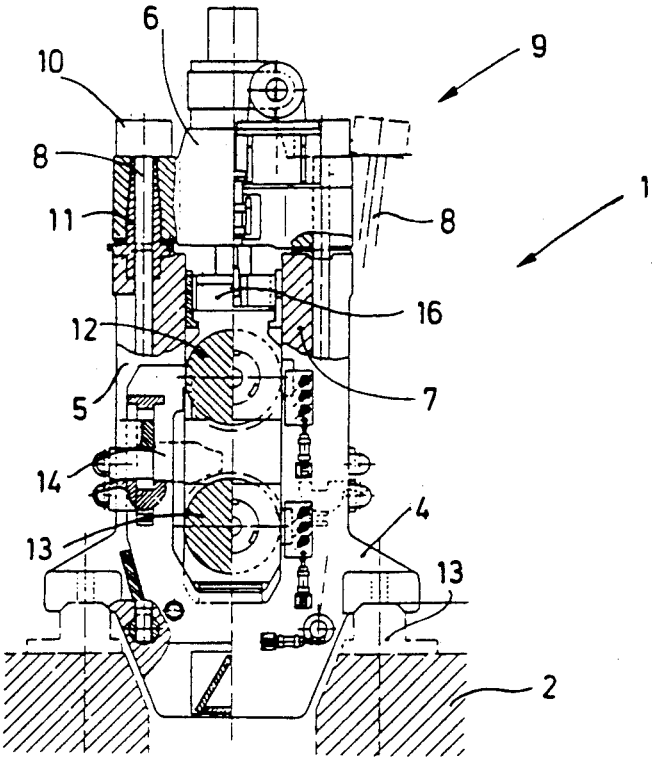
FIG. 1 is an elevational view, partly in section, of a rolling mill stand with two horizontal grooved rolls of open-top construction with pretensioned tie rods.

FIG. 1 of the drawing shows, partly in section, a rolling mill stand 1 which is supported on a foundation 2 and a base plate 3. The support claws 4 are fitted to the base plate 3 and have bores for conventional connecting means, such as screws or the like. The rolling mill stand is a divided or split stand. The roll housings 5 are connected to each other by stand tops 6. The tops 6 engage over the housing posts 7 of each roll housing.

A tie rod 8 is arranged at each housing post. The tie rods 8 are hinged to the lower portions of the housing post in such a way that a mechanically controlled swinging of the tie rod is possible. The swung-out position of the tie rod is denoted by reference numeral 9. A hydraulic tensioning nut 10 of conventional construction, not shown in detail, is arranged in the tie rod head. The tops 6 and the roll housings 5 are connected by means of the hydraulic tensioning nut 10 and by means of the tie rod 8 with high tensioning force, so that a rolling mill stand is obtained which has the characteristics of closed rolling mill stands. Horizontal grooved rolls 12, 13 supported in chocks are arranged in the rolling mill stand. FIG. 1 also shows the guide fittings 14 for the rolled material.

Figure 2:
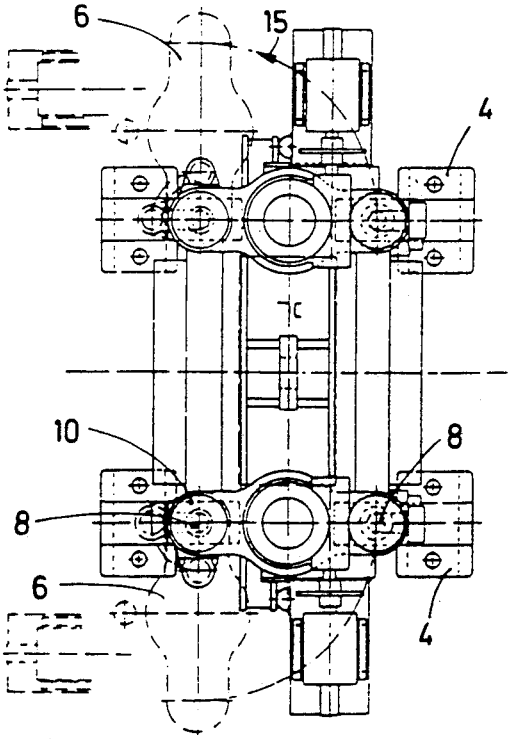
FIG. 2 is a top view of the stand of FIG. 1.

The top view of the open-top stand 1 of FIG. 2 shows the roll housings 5 and the support claws 4. The tie rods 8 are arranged in the housing posts 7. The tie rod head with tensioning nut is denoted by reference numeral 10. Arrow 15 in a dash-dot line indicates that the stand tops 6 are pivotable. The swung-out position of the tops 6 is shown in broken lines.

A bearing sleeve 11 arranged between tie rod 8 and top 6 as shown in FIG. 1 supports the pivoting movement of the tops 6. For pivoting the tops 6, the hydraulic tensioning nuts 10 are loosened and the tie rods 8 on one side of the housing 5 are pivoted into position 9 shown in FIG. 1. When the tops 6 are swung out, the stand is open toward the top, so that the set of rolls with the horizontal grooved rolls 12, 13 can be lifted cut of the stand by means of a crane unit. New grooved rolls can then be placed in the stand within a short time and without requiring substantial assembly operations.

The above-described open-top stand with two horizontal grooved rolls is to be used as a roughing and finishing stand, for example, for the manufacture of lightweight sections having high surface quality and narrow tolerances. For this purpose, it is necessary that the stand operator knows the spring characteristic of the stand for the respective state of operation and for different grooved rolls, in order to be able to take into consideration the springiness of the stand when rolling sections.

For determining the spring characteristic of the above-described open-top stand with horizontal grooved rolls, wherein at least the upper horizontal roll 12 is adjustable, the horizontal roll 12 is moved by the electromechanical adjustment unit 16 for the rolls with decreasing speed toward the lower horizontal grooved roll 13, wherein the adjustment speed becomes zero at the moment the two rolls come into contact. All hydraulic tensioning nuts 10 are then released, so that the electromechanical adjustment unit is in the unloaded state and is adjustable while maintaining the roll contact. The electromechanical adjustment unit 16 is closed by a preselected adjustment distance L, so that the stand top and the housing posts are loosely spaced from each other. Subsequently, all hydraulic tensioning nuts 10 are pretensioned, for example, with a force of 100 tons, wherein the top 6 rests on the post 7, thereby causing a mechanical synchronization of all forces. The forces introduced by means of the tensioning nuts into the stand are measured in the conventional manner as a rolling force F between the roll bodies.

Figure 3:
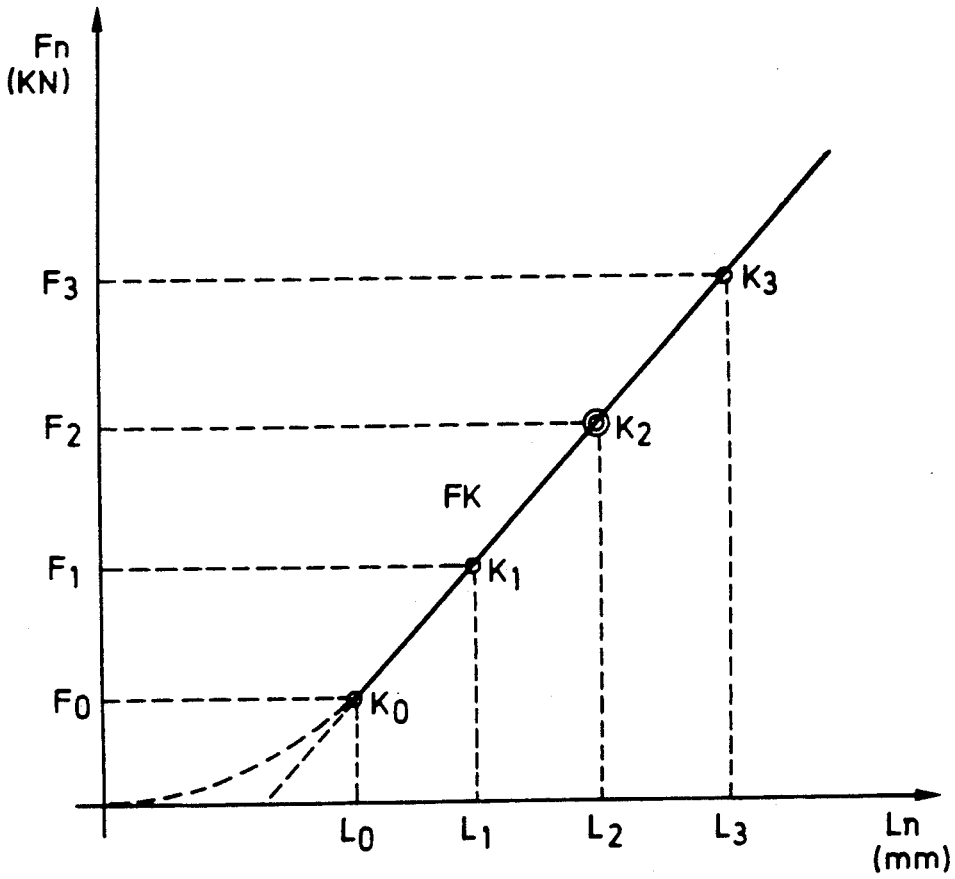
FIG. 3 is a diagram showing the spring characteristic of the stand of FIGS. 1 and 2.

The adjustment distance L1 and the measured rolling force F1 can be entered, independently of the computer input and the computation by the computer, into a force/distance diagram as shown in FIG. 3, resulting in the first spring characteristic value K1.

For determining the second spring characteristic value K2, the above steps are repeated in a second cycle as follows. All hydraulic tensioning nuts are untensioned for a second time and the electromechanical adjustment unit is closed by another predetermined adjustment value L2, so that the tops 6 and the posts 7 are again loosely spaced from each other. The tensioning nuts are then pretensioned for a second time, for example, with a force of 500 tons, wherein the applied forces are measured as rolling force F2 between the roll bodies. The adjustment distance L2 and the measured rolling force F2 are then entered in the force/distance diagram of FIG. 3, resulting in the spring characteristic value K2.

If another third spring characteristic value K3 is required, the above-described sequence of steps is repeated for a third time. The characteristic values K1, K2 and possibly K3 are connected to each other and serve to determine the spring characteristic FK of the open-top stand.

Of course, the diagram shown in FIG. 3 can be shown on a display which is connected to the computing unit for determining the individual spring characteristic values $K_n$. The rolling forces F and the adjustment distances L of the electromechanical adjustment unit are measured by means of conventional pressure pickups or conventional distance pickups or the like.

When the spring characteristic FK of the open-top stand has been determined in the manner described above, the springiness of the stand can be exactly assigned to the rolling force and can be taken into consideration in the pass schedule for manufacturing a certain section which is accurate to size. The spring characteristic determined in this manner can be used particularly in rolling sections with rolls which are moved toward each other and are under pretension, wherein the pretensional force, for example, F3, is always greater than, for example, the rolling force F2 and the adjustment L3 which determines the size can be taken from the force/-distance diagram of FIG. 3.

The above-described method for determining the spring characteristic of an open-top stand of the described type can be used with the same advantages in a rolling mill stand which has been reassembled from a universal stand to a two-high stand of tension rod construction with tensioning nuts.

While a specific embodiment of the invention has been shown and described in detail to illustrate the application of the inventive principle, it will be understood that the invention may be embodied otherwise without departing from such principles.

We claim:

1. A method of determining the spring characteristic of a roughing and finishing roll stand and of adjusting a roll gap of the roll stand prior to rolling, particularly for rolling lightweight sections with narrow tolerances, the roll stand being a universal stand which is reassembled to a two-high stand with tie rods and a hydraulic tensioning device for the tie rods, wherein at least one horizontal roll of the stand is adjustable by means of an electromechanical adjusting unit, the method comprising moving at least the upper of the horizontal rolls by means of the electromechanical adjustment unit of the rolls toward the other roll, applying the rolling forces to be measured between the roll bodies by the hydraulic tensioning device, and adjusting by predeterminable adjustment distances the electromechanical adjustment unit in the unloaded state while maintaining roll contact.

2. A method of determining the spring characteristic of a roughing and finishing roll stand and of adjusting a roll gap of the roll stand prior to rolling, particularly for rolling lightweight sections with narrow tolerances, the roll stand having a swingable stand top which connects housing posts of stand housings, wherein the stand top is connected to the housing posts by means of tie rods which are pretensioned by means of a hydraulic tensioning device, wherein at least one horizontal roll of the stand is adjustable by means of an electromechanical adjusting unit, the method comprising moving at least the upper of the horizontal rolls by means of the electromechanical adjustment unit of the rolls toward the other roll, applying the rolling forces to be measured between the roll bodies by the hydraulic tensioning device, and adjusting by predeterminable adjustment distances the electromechanical adjustment unit in the unloaded state while maintaining roll contact, and further comprising determining a first spring characteristic value through a pressure increase adjusted above a pretensioning pressure in the hydraulic tensioning device while simultaneously measuring the corresponding rolling force between the roll bodies and the corresponding adjustment distance, and determining at least one additional spring characteristic value by carrying out in a repeatable cycle:

untensioning the hydraulic tensioning device;

moving the electromechanical adjustment unit by a predetermined adjustment distance, so that the stand top and the housing posts are loosely spaced apart;

pretensioning the hydraulic tensioning device, and measuring the force applied as a result as rolling force between the roll bodies; and feeding the adjustment distance and the measured rolling force to a computer unit for determining the at least one additional spring characteristic value and for determining the spring characteristic of the stand therefrom, wherein, during any subsequent cycles, different forces are applied to determine different characteristic values.

3. The method according to claims 2 or 1, wherein the upper horizontal roll is moved by means of the electromechanical adjustment unit with decreasing speed toward the lower horizontal roll, and wherein the adjustment speed becomes zero at the moment the rolls come into contact.

4. The method according to claims 2 or 1, wherein the tensioning device is a tensioning nut, comprising applying hydraulic pressure to the tensioning nut during operation.

5. The method according to claims 2 or 1, wherein the tensioning device is unloaded from hydraulic pressure during operation by means of insertable pressure pieces.

6. The method according to claims 2 or 1, comprising utilizing the spring characteristic of the roughing and finishing stand for rolling sections, wherein the rolls are moved together and a pretensioning force is applied to the rolls, wherein the pretensioning force is maintained always greater than the rolling force.

* * * * *